United States Patent [19]

Fein

[11] Patent Number: 4,825,931

[45] Date of Patent: May 2, 1989

[54] WALL TRACK INSTALLATION DEVICE

[75] Inventor: Harvey C. Fein, New York, N.Y.

[73] Assignee: DFB Sales, Inc., Long Island City, N.Y.

[21] Appl. No.: 189,448

[22] Filed: May 2, 1988

[51] Int. Cl.[4] ..... E04B 1/00

[52] U.S. Cl. ..... 160/327; 33/645; 52/DIG. 1; 52/222; 81/119; 81/488

[58] Field of Search ..... 160/327, 328; 33/526, 33/645; 52/DIG. 1, 222; 81/488, 119

[56] References Cited

U.S. PATENT DOCUMENTS 4,625,490 12/1986 Baslow ..... 160/327 X

*Primary Examiner*—Blair M. Johnson

*Attorney, Agent, or Firm*—Blum Kaplan

[57] ABSTRACT

A wall track installation device for use in installing fabrics on a wall, with the fabric being suspended on the wall by sections of plastic wall track each having a base including first and second opposed edges, a first shoulder having a free end extending outwardly from the first edge, a second shoulder extending outwardly from the second edge and a panel hingedly coupled to the second shoulder and adapted to lock over the first shoulder to capture the fabric therebetween. The device includes an elongated frame having a third edge with a groove formed therein sized to receive the free end of the first shoulder therein. The third edge further includes a raised surface having a predetermined thickness which extends along the length of the groove. The raised surface is adapted to abut against the edge of a wall when in use, and the free end of the first shoulder of the track is positioned in the groove to permit proper positioning and spacing of the wall track on a wall to provide for sufficient clearance for the fabric against the wall when the fabric is captured in the wall track.

8 Claims, 4 Drawing Sheets

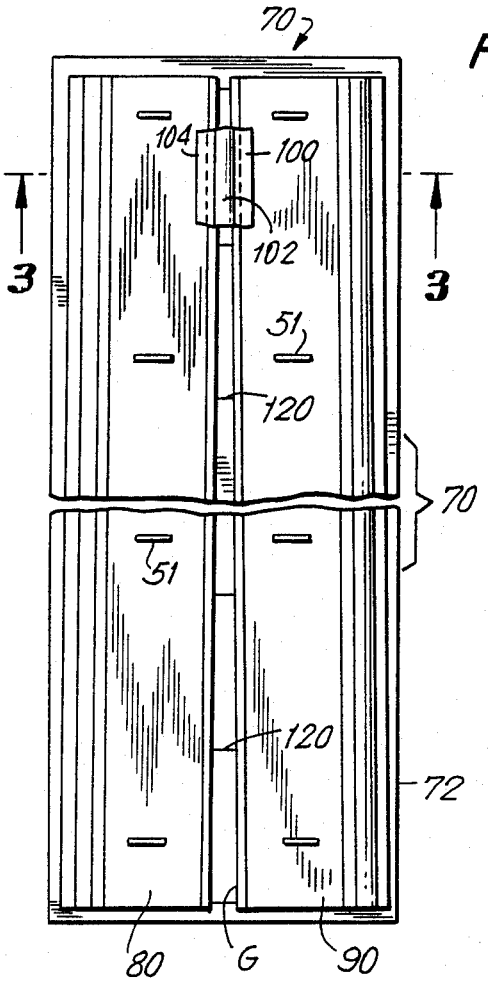
FIG. 1
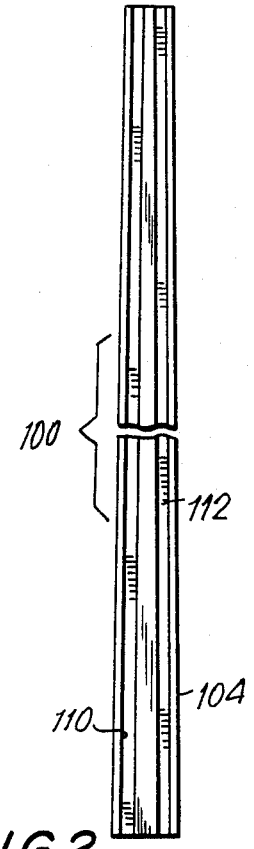
FIG. 2
FIG. 3
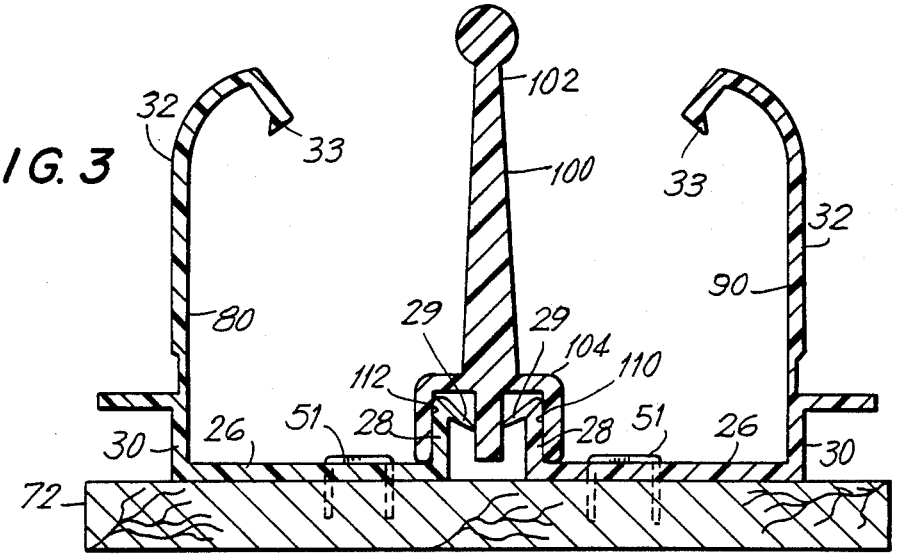

FIG. 4
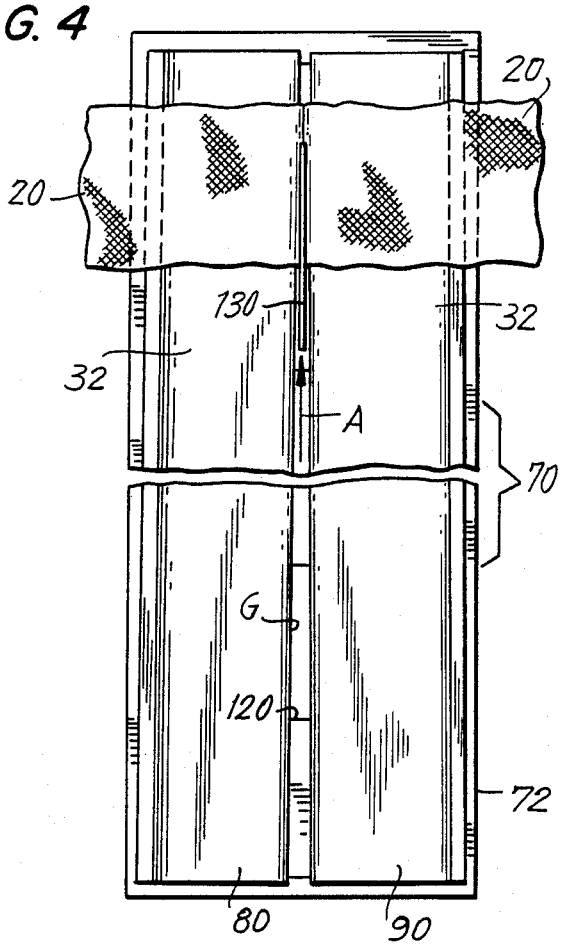
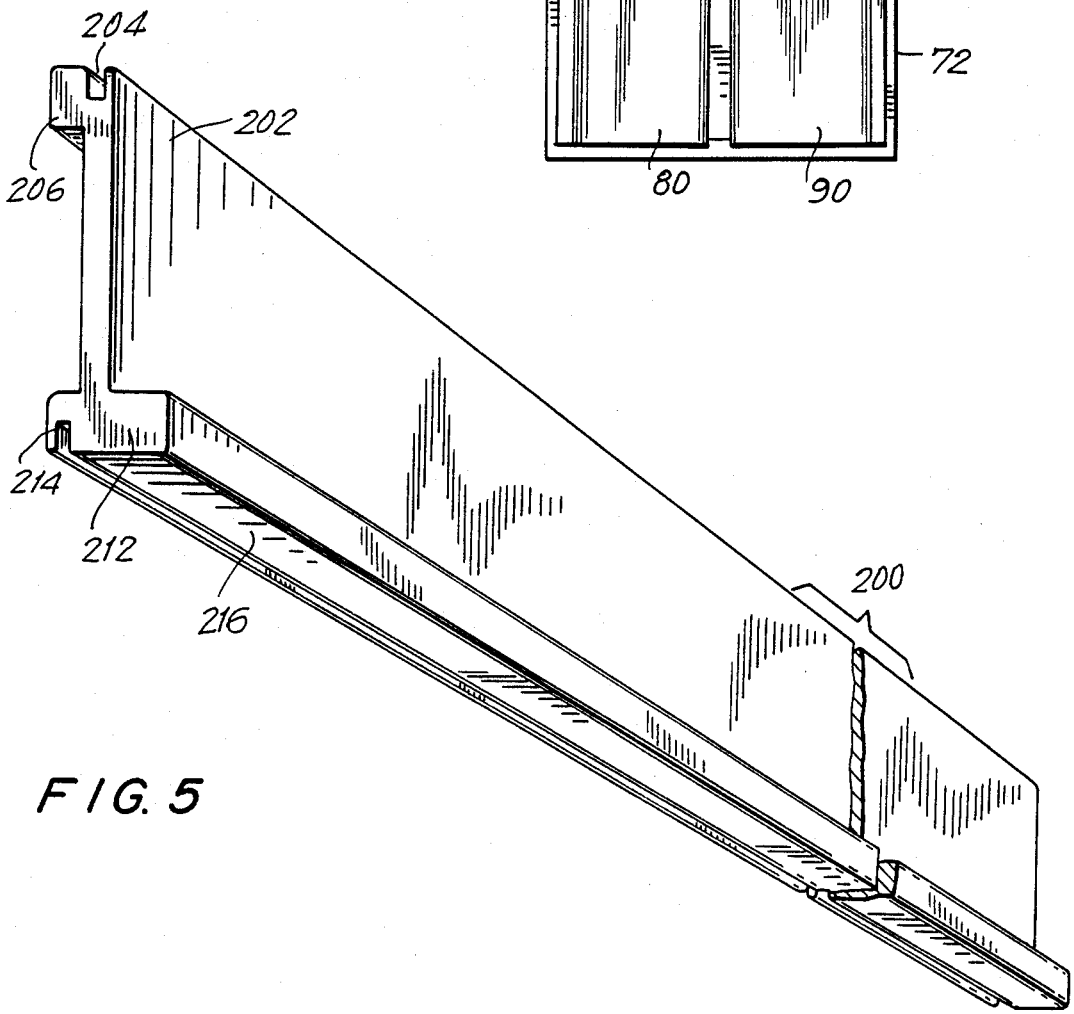
FIG. 5

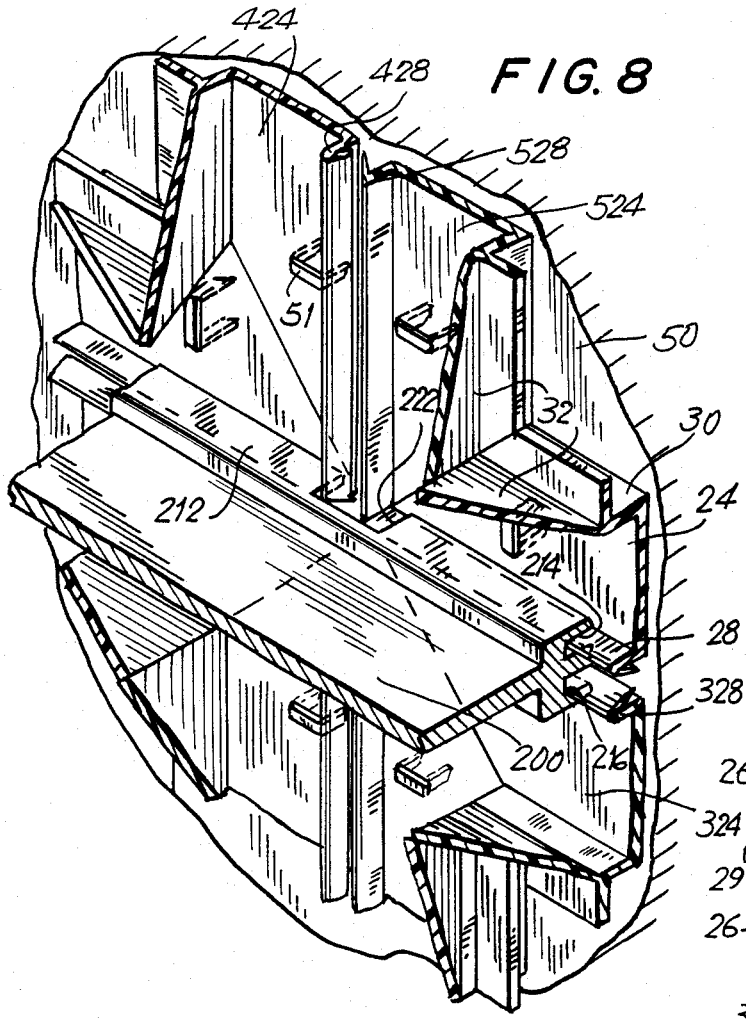
FIG. 8
FIG. 9
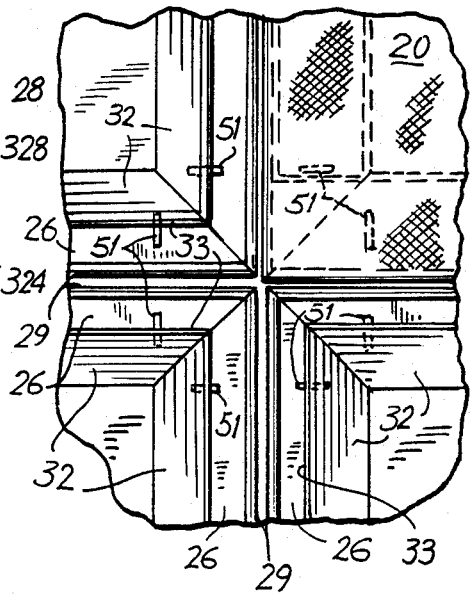
FIG. 10
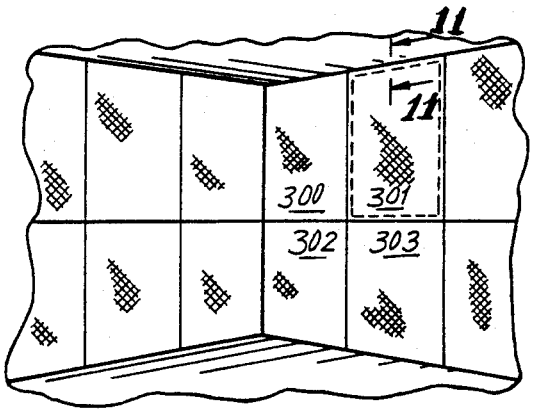
FIG. 11
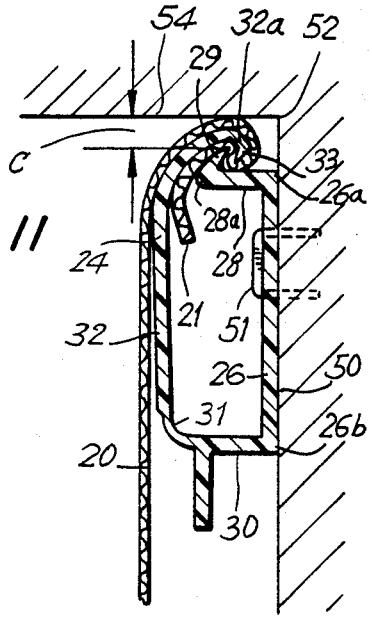

WALL TRACK INSTALLATION DEVICE

BACKGROUND OF THE INVENTION

The present invention is directed generally to a wall track installation device for use in installing plastic wall track on a wall which is adapted to hold a fabric material and, in particular, to a wall track installation device which assists in properly positioning plastic wall track sections at the edges of the wall and at the positions where abutting panels are to be formed in order to insure a neat and proper installation.

In recent years, it has become quite popular to upholster walls of rooms in a building by suspending fabric wall covering thereon. In one such type of system, plastic track pieces are glued or stapled to the periphery of a wall, and cut sections of fabric are supported from and suspended by the track pieces to cover the wall. One such type of system using plastic track pieces with a dilatable inlet and wall fabric for upholstering a wall is described in U.S. Pat. No. 4,018,260.

Another type of plastic track used to support a fabric on a wall is disclosed in U.S. Pat. No. 4,676,016 and German Pat. No. 2,207,954. In the track disclosed in the '016 patent and the German '954 patent, the track is formed from a plastic material and includes a flat base portion adapted to be affixed to the wall having a first shoulder extending outwardly therefrom and a second movable portion hingedly secured to the flat base portion and adapted to snap lock onto the first portion whereby fabric can be held between the locking jaws thereof.

Because of the manner in which the second movable portion locks over the first portion, a small, but sufficient clearance is required at the edges of the wall, such as where the ceiling meets the wall, and in corners. In addition, a small but sufficient clearance between abutting track pieces is required when abutting panels are to be utilized with first and second plastic wall track pieces which oppose one another.

It has proven quite difficult in installing plastic track sections to provide a straight and neat appearance at such edges and corners and with abutting panels. Moreover, since different types of fabric have different thicknesses, the distance from edges or abutting panels will vary depending on the type of fabric to be installed in the track. Accordingly, it is appropriate to provide a device for determining the necessary spacing from the edge of the wall or from an opposing track which is required to properly support the fabric. It is also appropriate to provide a device which assists in the accurate installation of plastic track sections.

Accordingly, it is desired to provide a wall track installation device which determines the necessary spacing to permit a complete and proper installation and which assists in the straight and neat installation of plastic wall track on a wall prior to installation of the fabric.

SUMMARY OF THE INVENTION

Generally speaking, in accordance with the present invention, a wall track installation device for use in installing plastic wall track on a wall prior to installation of fabric on the wall track, is provided. The wall track installation device is used in conjunction with plastic wall track which includes a base having first and second opposed edges, a first shoulder having a free end extending outwardly from the first edge, a second shoulder extending outwardly from the second edge and a panel hingedly coupled to the second shoulder and adapted to lock over the first shoulder to capture fabric therebetween. The installation device includes an elongated frame having a third edge with a groove formed therein sized to receive the free end of the first shoulder therein. The third edge further includes a raised surface extending along the length of the groove, with the raised surface abutting the edge of a wall and the first shoulder of the track being positionable in the groove to properly position and space the wall track on the wall to permit clearance for the fabric when the fabric is captured in the wall track.

In a preferred embodiment, the frame includes a fourth edge with parallel grooves formed therein, with the distance between the parallel grooves being essentially twice the distance from the first groove to the raised surface. This fourth edge of the frame is utilized to properly position and space abutting wall track sections on a wall so that when fabric is ready to be installed in the opposing tracks, sufficient, yet appropriate clearance is provided to permit locking of the track sections without interference.

In addition, the wall track installation device includes a measurement device for determining the appropriate frame to be utilized depending on the thickness of the fabric involved.

Accordingly, it is an object of the present invention to provide a plastic wall track installation device for installing plastic wall track on a wall.

Another object of the present invention is to provide a wall track installation device which includes a frame for properly positioning plastic wall track at the edges of the wall.

A further object of the present invention is to provide a wall track installation device which utilizes a frame to properly position abutting plastic wall track to provide a neat and straight abutting wall panel construction.

A still further object of the present invention is to provide a wall track installation device which provides a device for measuring the clearance needed for a particular fabric to be installed on a wall.

Yet another object of the present invention is to provide an improved wall track installation system which includes a measurement device for determining the clearance necessary for installation of the plastic wall track, and a device for use in installing plastic wall track on a wall which provides such clearance.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is an elevational view of a measurement tool utilized to determine the spacing or clearance necessary at the edge of a room and between abutting panels with different types of fabrics used in conjunction with the present invention;

FIG. 2 is an elevational view of a forming tool utilized to construct the measurement tool depicted in FIG. 1;

FIG. 3 is an enlarged sectional view taken along line 3—3 of FIG. 1 showing the manner in which the tool depicted in FIG. 2 is utilized to construct the device depicted in FIG. 1;

FIG. 4 is an elevational view showing the manner in which the measurement tool of FIG. 1 is utilized to determine the necessary spacing and clearance of plastic wall track;

FIG. 5 is a perspective view of a blank frame which is utilized to form the installation tool according to the present invention;

FIG. 8 is a partial perspective and sectional view of a wall showing the manner in which the tool of FIG. 6 is utilized to position abutting wall track on a wall;

FIG. 9 is an elevational view of a wall after a corner has been formed by opposing plastic track through use of the tool depicted in FIGS. 6 and 8;

FIG. 10 is a perspective view of the corner of a room showing a plurality of abutting fabric panels utilizing a plastic wall track and installed in accordance with the present invention; and FIG. 11 is an enlarged sectional view taken along line 11—11 of FIG. 10.

DESCRIPTION OF THE PREFERRED EMBODIMENTS

Figure 6:
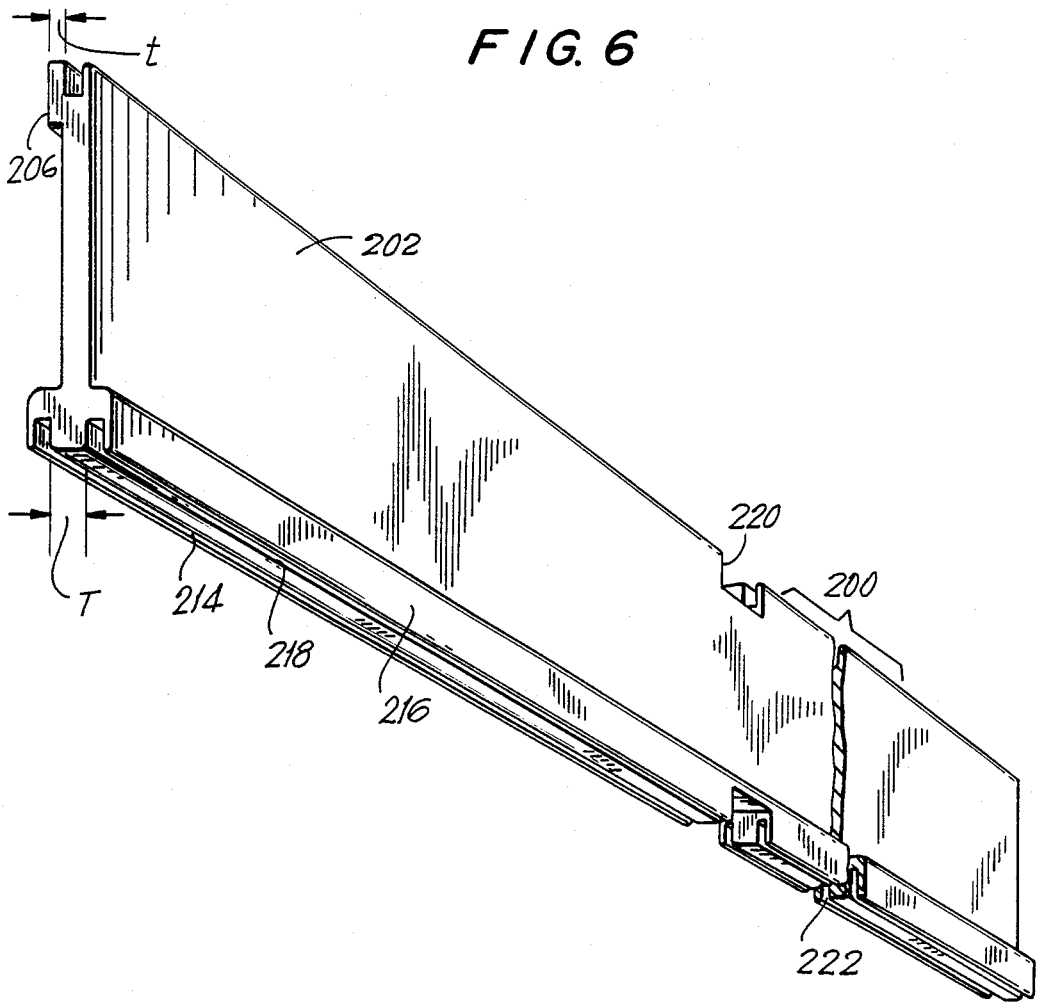
FIG. 6 is a perspective view of the installation tool depicted in FIG. 5 after appropriate dimensions and grooves have been added thereto.

Reference is first made to FIG. 11 of the drawings which depicts a fabric 20 supported on a plastic wall track 24 secured to a wall 50 at a corner 52 formed with wall 54. Track 24 includes an elongated flat base portion 26 which is stapled or otherwise affixed to wall 50 by means of staples 51, for example. A first shoulder 28 extends outwardly from first edge 26*a* of base 26 away from wall 50. A second shoulder 30 extends outwardly from second edge 26*b* of base 30 away from wall 50. A first panel 32 is hingedly secured to second shoulder 30 through a living hinge 31.

First shoulder 28 includes a lip or locking jaw 29 which extends upwardly from free end 28*a* thereof. Similarly, free end 32*a* of pivotable panel 32 includes a second lip or locking jaw 33 adapted to lock over first lip 29 on first shoulder 28. The edge or selvage portion 21 of fabric 20 is captured between and locked in position by the interlocking of first locking jaw 29 and second locking jaw 33. Due to the construction including the curvature and thickness of free end 32*a* of panel 32, a minimum clearance C is required from wall 54 to first shoulder 28 so as to permit the portion of fabric 20 abutting wall 54 to have sufficient clearance.

Various types of fabric may be utilized as a wall upholstery material. Such different fabrics have different thicknesses. For example, fabrics can vary anywhere from 5/1000" to 70/1000". A silk material, for example, is about 5/1000" in thickness. Cotton materials generally run between 20 and 30/1000". A nylon material may have a thickness on the order of 65/1000". In order to provide a neat and clean appearance at the edge of a room, it is necessary for track 24 to be properly positioned on the wall so that when fabric 20 is captured therein and locked thereto, fabric 20 will abut wall 54 but will not be too tightly pressed thereagainst to prevent or interfere with the locking of the wall track.

In one form of track utilized by applicant, 245/1000" clearance must be provided from the tip of jaw 32*a* to wall 54 just for second jaw 33 to lock thereover. An additional clearance must be provided according to the thickness of the fabric. Thus, with fabric ranging between 5/1000 and 70/1000" in thickness, it is necessary to provide clearances between 250/1000 and 315/1000".

Accordingly, it is initially required to determine the precise clearance necessary depending on the fabric utilized in order to form the frame tool appropriate to insure such spacing. Reference is made to FIGS. 1 through 4 which depict a measuring device, generally indicated at 70, utilized to measure the necessary clearance. Measuring device 70 is constructed from a board 72 to which opposing plastic wall tracks 80 and 90 are affixed by means of staples 51. It is seen from FIGS. 1 and 4 that tracks 80 and 90 are inclined towards one another so that the gap G therebetween decreases in width towards the top of the board. A measurement tool 100 is utilized to properly position tracks 80 and 90 on board 72. Measurement tool 100 is formed from an extruded metal material such as aluminum and includes a handle portion 102 and a base portion 104. Inclined grooves 110 and 112 are formed in base portion 104 of measurement tool 100 through a milling operation or the like. In a preferred embodiment, grooves 110 and 112 are inclined towards one another so that for every inch therealong, the change in spacing is 10/1000". Markings 120 are provided at each inch apart to provide a visual indication of the distance apart.

Measuring device 70 is utilized in the following manner as explained with reference to FIG. 4. Cut sections of the fabric 20 to be supported on the wall are locked in opposing track sections 80 and 90 on board 72 at a position where closing off panels 32 is relatively tight. Thereafter, a card, such as a business card 130 or the like, is moved along gap G in the direction of arrow A until resistance is felt. At that point, the scale in gap G is read and the appropriate thickness is determined.

FIG. 5 is a perspective view of the extruded metal blank utilized to form the installation tool as hereinafter described. Blank installation tool 200 is extruded from a metal material such as aluminum and includes a first edge 202 and a second edge 212. Edge 202 of blank 200 includes a groove 204 cut therein and extending therealong, and an enlarged head 206. Second edge 212 includes a groove 214 fromed therein and extending therealong and an enlarged head 216. Once the necessary dimensions are determined as described above utilizing the device depicted in FIG. 4, a portion of enlarged head 206 is appropriately removed so that the thickness t of head 206 as depicted in FIG. 6 corresponds to the clearance necessary for fabric 20 and free end 32*a* of panel 32.

In addition, a second groove 218 is cut in enlarged head 216 parallel to groove 214 and spaced so that the distance T therebetween as shown in FIG. 6 is twice the thickness t of head 206, i.e.

$$T=2t.$$

Figure 7:
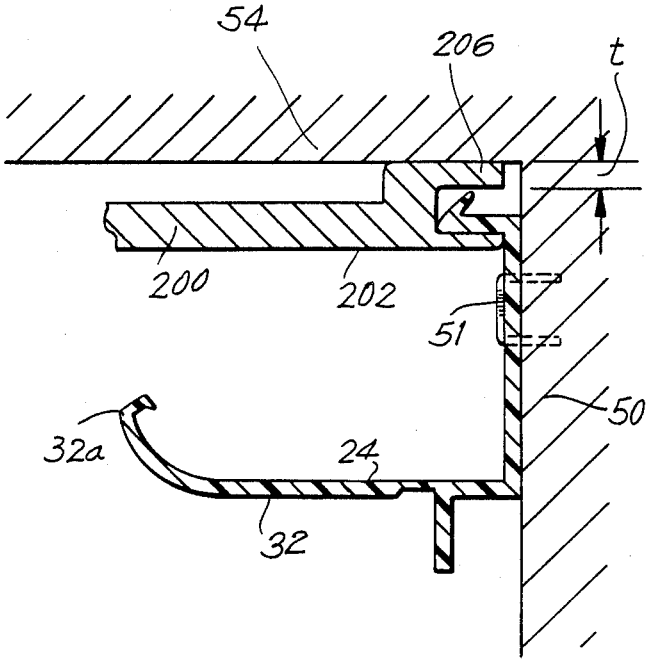
FIG. 7 is a sectional view of the corner of a room showing the manner in which the tool of FIG. 6 is utilized to properly position plastic wall track.

As depicted in FIG. 7, first edge 202 of installation tool 200 is utilized to appropriately position wall track 24 on wall 50 and spaced from wall 54. When panels are to abut such as panels 300, 301, 302 and 303 depicted in FIG. 10, second edge 212 of installation tool 200 is utilized as depicted in FIG. 8. The free end 28 of first track section 24 is inserted in groove 214 of installation piece 200. The first shoulder 328 of a second track section 324 is inserted in second groove 216 of installation tool 200. A proper distance between first shoulder 28 of track piece 24 and first shoulder 328 of second track piece 324 is maintained by installation 200, whereafter the track pieces are stapled to wall 50.

It is noted that installation tool 200 includes a cut-out 220 on the first edge 202 thereof and a second cut-out 222 on the second edge 212 thereof to provide clearance for the corners of abutting track section as depicted in FIG. 8. In this manner abutting panels 300, 301, 302 and 303 can be readily formed with proper and complete spacing between the track sections. In a preferred embodiment, tool 200 is 9" in length, although it is noted that other sizes may be used.

After the track sections are properly installed, fabric 50 is inserted and locked in the track pieces to form the complete wall fabric installation. It is noted that the ends of the track sections in FIGS. 8 and 9 are mitered at 45° in order to form right angles at the corners of each of the abutting panels.

The wall track installation device and system of the present invention provides a complete system and the necessary tools for properly installing the track pieces at the proper spacing on the wall. The system provides proper placement of track pieces at the edges and corners of a wall as well as between adjacent track pieces when abutting panels are to be formed.

The frames are made in black and then can be readily cut and grooved to correspond to the proper spacing. The system is easy to use, yet provides the means necessary to insure a neat and professional job.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wall track in combination with an installation device for use in installing fabrics on a wall, said fabric being suspended on the wall by sections of plastic wall track each having a base including first and second opposed edges, a first shoulder having a free end extending outwardly from said first edge, a second shoulder extending outwardly from said second edge, and a panel hingedly coupled to said second shoulder and adapted to lock over said first shoulder to capture a portion of said fabric therebetween, said installation device comprising an elongated frame having a third edge with a groove formed therein sized to receive the free end of said first shoulder therein, said third edge further including a raised surface having a predetermined thickness extending along the length of said groove, said raised surface being adapted to abut the edge of a wall when in use, and said free end of said first shoulder of said track being positionable in said groove to permit proper positioning and spacing of said wall track on the wall to provide for sufficient clearance for said fabric against said wall edge when said fabric is captured in said wall track.

2. The wall track and installation device as claimed in claim 1, wherein said predetermined thickness of said raised surface corresponds to the thickness of said fabric plus the height of said panel when locked over said first shoulder.

3. The wall track and installation device as claimed in claim 2, wherein the predetermined thickness of said raised surface is essentially in the range of 250/1000" and 315/1000".

4. The wall track and installation device as claimed in claim 1, wherein said frame includes a fourth edge with parallel grooves formed therein, the distance between said parallel grooves being essentially twice the distance from said first groove to said raised surface, the first shoulders of first and second opposing wall track sections being positionable in said parallel grooves on a wall to properly position and space said first and second wall tracks apart on said walls in abutting relation.

5. The wall track and installation device as claimed in claim 4, wherein said fourth edge includes a lateral slot cut therein adapted to accommodate crossing pieces of track sections.

6. The wall track and installation device as claimed in claim 4, wherein said parallel grooves are spaced apart essentially in the range between 500/1000" and 630/1000".

7. The wall track and installation device as claimed in claim 1, wherein said predetermined thickness of said raised surface is determined by measuring the thickness of said fabric on a device comprising a board having first and second inclined opposing track sections supported therein, portions of said fabric being releaseably locked in said opposing track sections, and a card being moved along the space therebetween until resistance is felt.

8. The wall track and installation device as claimed in claim 4, wherein said frame is formed as a blank, said raised surface being dimensioned from said blank and the spacing between said grooves on said fourth edge being determined after the thickness of said fabric is measured.

* * * * *